US008066477B2

(12) United States Patent
Markovitch

(10) Patent No.: US 8,066,477 B2
(45) Date of Patent: Nov. 29, 2011

(54) STAGED CENTRIFUGAL PUMP APPARATUS FOR PUMPING A VISCOUS FLUID

(75) Inventor: Peter Theodore Markovitch, Calgary (CA)

(73) Assignee: Dalmatian Hunter Holdings Ltd., Calgary, Alberta (CA)

( * ) Notice: Subject to any disclaimer, the term of this patent is extended or adjusted under 35 U.S.C. 154(b) by 505 days.

(21) Appl. No.: 12/379,806

(22) Filed: Mar. 2, 2009

(65) Prior Publication Data

US 2010/0221105 A1 Sep. 2, 2010

(51) Int. Cl.
*F04D 29/44* (2006.01)
*F04D 29/54* (2006.01)

(52) U.S. Cl. ..... 415/199.2; 415/199.1

(58) Field of Classification Search ..... 415/199.2, 415/199.1, 206, 211.2
See application file for complete search history.

(56) References Cited

U.S. PATENT DOCUMENTS 4,802,819 A * 2/1989 Bevington et al. ..... 415/199.3
5,201,848 A * 4/1993 Powers ..... 415/199.1

FOREIGN PATENT DOCUMENTS

| | | |
|---|---|---|
| CA | 2229018 | 5/1999 |
| CA | 2185176 | 5/2002 |
| CA | 2235045 | 11/2002 |
| CA | 2543970 | 5/2005 |

* cited by examiner

*Primary Examiner* — Chuong A Luu
*Assistant Examiner* — Nga Doan
(74) *Attorney, Agent, or Firm* — Gowling Lafleur Henderson LLP; D. Doak Horne

(57) ABSTRACT

A pump apparatus comprising a series of stacked impellers rotating about a common axis, for pumping a viscous fluid mixture upwardly from an underground location. The pump apparatus comprises a generally cylindrical housing having an intake at or near its suction end. A plurality of impellers are mounted in the housing to rotate about a shaft, which each induce flow of the mixture toward the discharge end of the pump. Each impeller has a series of radially outwardly extending vanes, one or more of such vanes having a radially-extending horizontal slot and arranged to generate an upwardly moving column of fluid. Without being limited to the theory of operation, the horizontal slot in the vanes assists in creating laminar flow and reducing turbulent flow.

18 Claims, 11 Drawing Sheets

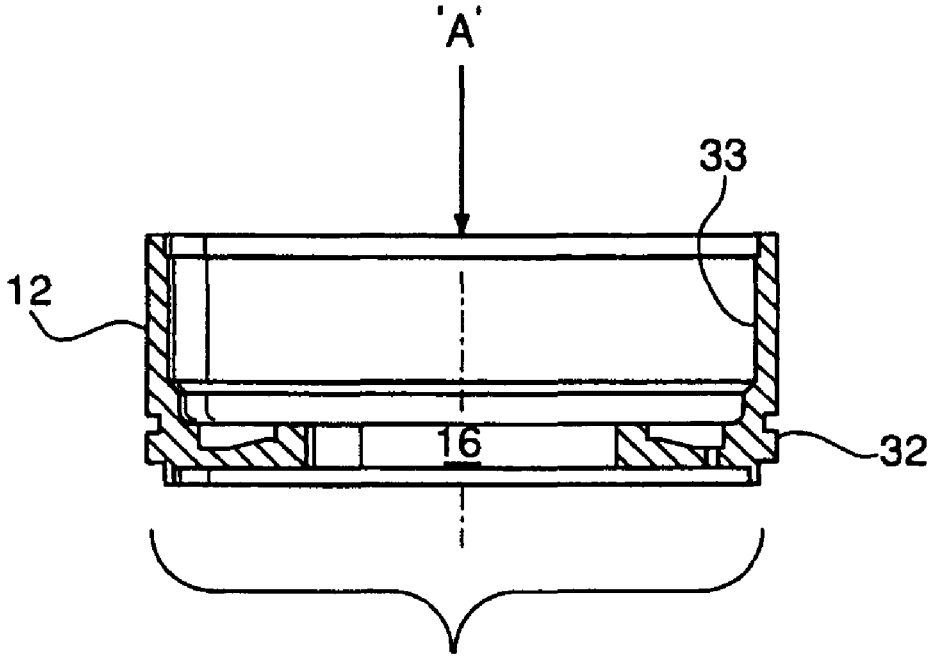
Fig.4a
Fig.4b
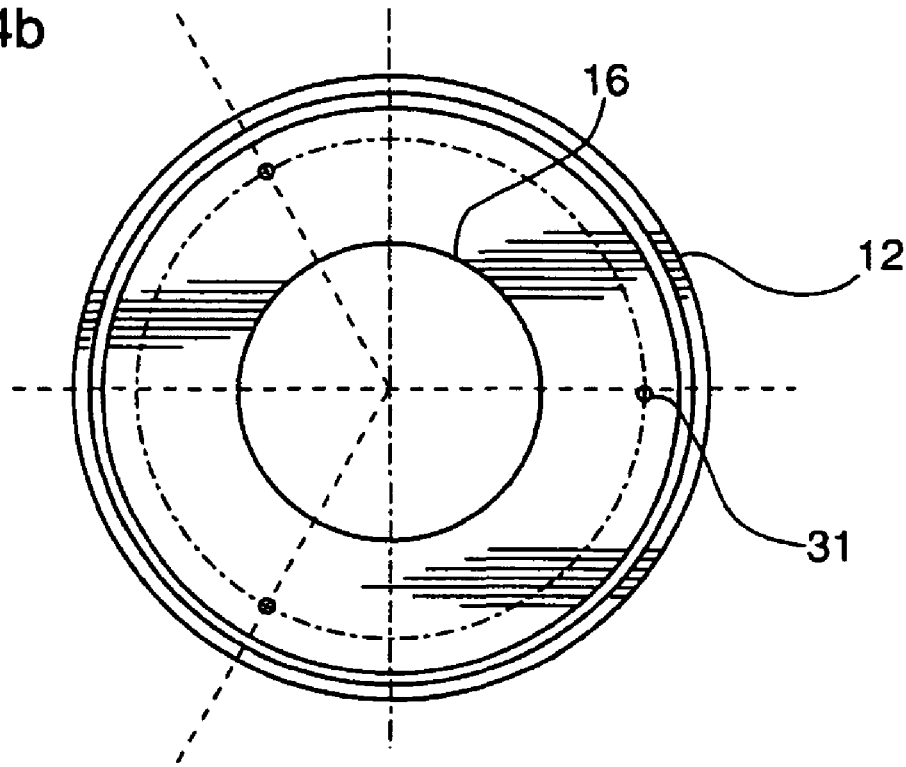

Fig.9a
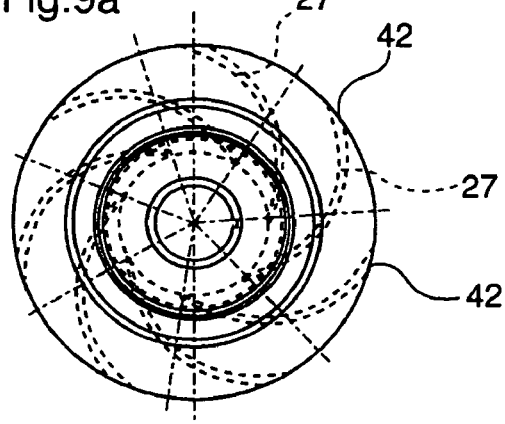
Fig.9b
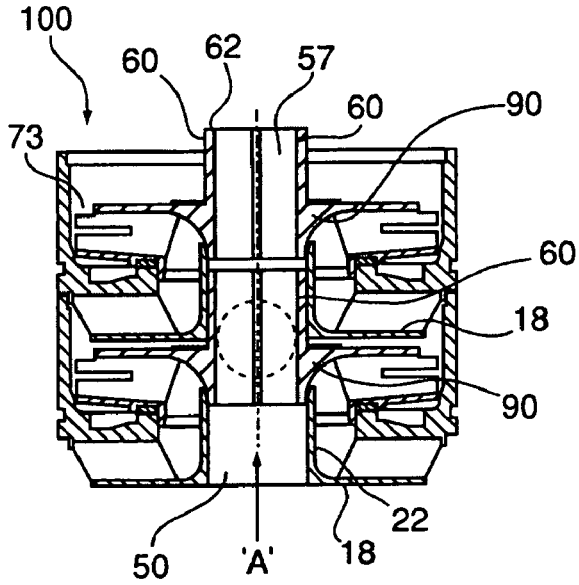
Fig.9c
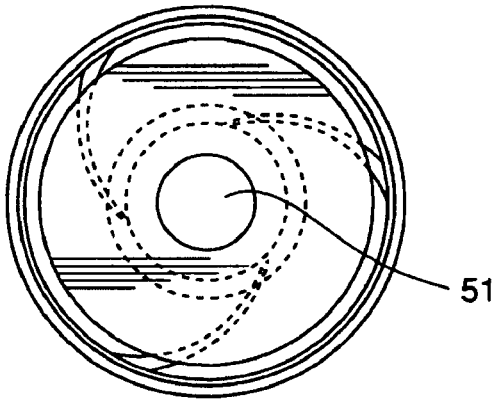
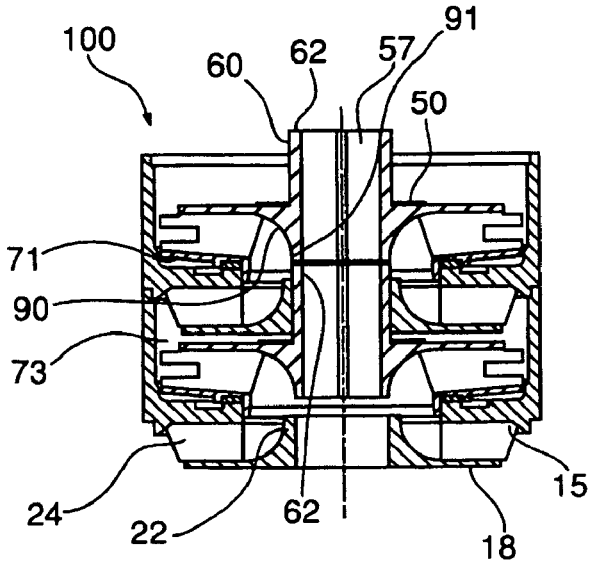
Fig.10

STAGED CENTRIFUGAL PUMP APPARATUS FOR PUMPING A VISCOUS FLUID

FIELD OF INVENTION

This invention relates to centrifugal pumps, and in particular to a modified centrifugal pump consisting of a series of stages for pumping viscous fluids, with improved impeller configuration to modify the flow of fluid to thereby reduce wear due to abrasion caused by such viscous fluids.

BACKGROUND OF INVENTION AND DESCRIPTION OF THE PRIOR ART

The extraction of heavy oil and/or bitumen from an underground hydrocarbon reservoir via the pumping of viscous hydrocarbon-containing mixtures to surface presents significant problems with respect to the erosion of mechanical equipment (such as the pumps) which are used to pump such viscous mixtures to surface.

The cause of the erosion is due largely in part to the high abrasiveness of the viscous pumped substance, and the presence of solid particles in the mixture, such as sand, silicates, and tailings.

In making its way through the pump mechanism, the viscous fluid particularly causes erosion of the impeller blades, which ultimately leads to wear and loss of performance, and indeed subsequent inoperability of the pump. The result of the ongoing wear on the apparatus causes significant downtime for repairs and replacements, increasing inefficiencies and ultimately increasing maintenance costs and pump failures.

Pump apparatus with impeller blades used in the handling of viscous fluids are found in the prior art, such as those disclosed in Canadian Patents 2,543,970, 2,185,176, 2,229,018 and 2,235,045.

Canadian Patent 2,543,970 teaches a centrifugal pump, having a wear plate coupled with a centrifugal pump and impeller apparatus. Wear plates add additional cost, and may in some cases reduce performance.

CA 2,185,176 discloses a pump/separator apparatus that utilizes an inner impeller with a stack of radially and concentrically extending circular disks.

Likewise, CA 2,229,018 discloses a pump/separator apparatus with impellers mounted within a cylindrical housing. The impellers found in CA 2,185,176 are in a diverging upwardly external shape. In CA 2,185,176 there are also internal pumping components located at each stack.

CA 2,235,045 teaches an impeller assembly with asymmetric concave blades.

However, there exists a real need in the industry for an pump apparatus that will provide substantial pressure and volumetric output, and be able to survive for an extended period of time without repair or replacement.

SUMMARY OF THE INVENTION

The present invention provides an improved staged pump apparatus for handling viscous fluids, which reduces the limitations of conventional pumps being prone to erosion and frequent issues with maintenance.

According to the invention, the improved impellers within the pump apparatus allow the pumping of viscous fluid upwardly in a laminar flow. By keeping the fluid in the laminar flow regime there is a decrease in the erosion of the impellers.

The pump apparatus of the present is stackable, which allows for a series of impellers whose respective inlets and outlets are arranged in series to incrementally boost pressures within a narrow well borehole of limited diameter.

Accordingly, in order to reduce the disadvantages of prior art centrifugal pumps being highly susceptible to erosion and wear when pumping viscous fluids having abrasive and wear-causing materials suspended therewithin, in a first broad embodiment of the present invention such invention provides a pump apparatus for pumping a viscous fluid upwardly, comprising:

a hollow, cylindrical body disposed about a central longitudinal vertical axis, having aperture means proximate a lower extremity thereof to allow ingress of said viscous fluid about an exterior periphery thereof and to direct said viscous fluid upwardly along said longitudinal axis and within said cylindrical body; said hollow cylindrical body comprising therewithin:

(i) a plurality of rotatable arcuate vane members, situated within said hollow cylindrical body and above said lower extremity and symmetrically radially disposed about said longitudinal axis, adapted for rotation about said longitudinal axis, each of said vane members extending radially outwardly from a position proximate said longitudinal axis to a position proximate an inner periphery of said hollow cylindrical body;

(ii) a flat, horizontally disposed disc member, disposed immediately above said vane members, perpendicularly disposed to said longitudinal axis;

(iii) a viscous fluid egress area proximate a radial extremity of said vane members and said disc member and situated about said periphery of said hollow cylindrical body; and (iv) each of said vane members possessing a radially-extending horizontal slot, extending from proximate a mid-section of each of said vane members radially outwardly to a position proximate a radial extremity of each of said vane members.

In a further broad aspect of the pump apparatus of the present invention, such pump apparatus is adapted to be coupled in series with at least one other pump apparatus along a vertical longitudinal axis thereof to provide a staged pump apparatus, for pumping a viscous fluid upwardly, comprising:

(a) a hollow, cylindrical body disposed about said longitudinal vertical axis, having aperture means proximate a lower extremity thereof to allow ingress of said viscous fluid about an exterior periphery thereof and to direct said viscous fluid inwardly and upwardly along said longitudinal axis and within said cylindrical body;

(b) a plurality of arcuate vane members, situated within said cylindrical body and above said lower extremity, adapted for rotation about said longitudinal axis, each of said vane members and extending radially outwardly from a position proximate said longitudinal axis to a position proximate an inner periphery of said hollow cylindrical body;

(c) a flat, horizontally disposed rotatable disc member, rotatable within said hollow cylindrical body about said longitudinal axis, perpendicularly disposed to said longitudinal axis;

(d) a viscous fluid egress area disposed above said vane members and situated about said periphery of said hollow cylindrical body; and (e) each of said vane members possessing a radially-extending horizontal slot, extending from proximate a mid-section of each of said vane members radially outwardly to a radial extremity of each of said vane members.

In a third broad aspect of the invention, a centrifugal pump apparatus is provided which is, adapted to be coupled in series with other similar centrifugal pump apparatus along a vertical longitudinal axis thereof to provide a staged pump apparatus, for pumping a viscous fluid upwardly, comprising:

(a) a hollow, cylindrical body disposed about said longitudinal vertical axis, having a lower horizontal wall perpendicularly disposed to said horizontal axis with a circular aperture therein co-axial with said longitudinal axis;

(b) a horizontal circular disc at a lowermost extremity of said hollow cylindrical body, perpendicularly disposed to said longitudinal axis and of lesser diameter than said cylindrical body, having an upwardly-extending cylindrical tubular member situated co-axial with said vertical longitudinal axis, adapted to receive a rotatable cylindrical shaft therein, said disc affixed to said lower horizontal wall and beneath said lower wall but spaced apart therefrom thereby forming aperture means beneath a lower extremity of said cylindrical body adapted to allow ingress of said viscous fluid about an exterior periphery of said cylindrical body and to direct said viscous fluid inwardly and upwardly along an exterior of said cylindrical member and within said cylindrical body;

(c) a plurality of rotatable vertically-extending vane members, situated within said cylindrical body and above said lower extremity, disposed about said longitudinal axis adapted for rotation about said longitudinal axis, each of said vane members extending radially outwardly from a position proximate said longitudinal axis to a position proximate an inner periphery of said cylindrical body and each adapted to propel said viscous fluid directed upwardly within said cylindrical body via said cylindrical member radially outwardly;

(d) a flat, horizontally disposed rotatable disc member, of lesser diameter than said cylindrical body, rotatable within said hollow cylindrical body about said longitudinal axis; and (e) each of said vane members possessing a radially-extending horizontal slot, extending from proximate a mid-section of each of said vane members radially outwardly to a radial extremity of each of said vane members.

BRIEF DESCRIPTION OF THE DRAWINGS

Additional advantages will become readily apparent to those skilled in the art from the following detailed description, wherein only preferred examples of the present concepts are shown and described.

Specifically, as will be realized, the disclosed concepts are capable of other and different embodiments, and its several details are capable of modifications in various obvious respects, all without departing from the spirit thereof. Accordingly, the drawings and description are to be regarded as illustrative in nature, and not restrictive. Further advantages and permutations will appear from the following detailed description of various non-limiting embodiments of the invention, taken together with the accompanying drawings, in which:

FIG. 4*a* is a side cross-sectional view of the upper portion of the hollow cylindrical pump body of the present invention;

FIG. 4*b* is a view on arrow "A" of FIG. 4*a;*

FIG. 9*a* is a top view of a series of stacked nested centrifugal impellers which comprise part of the pump apparatus of the present invention;

FIG. 9*b* is a side cross-sectional view of a series of stacked, nested centrifugal impellers which comprise part of the pump apparatus of the present invention;

FIG. 9*c* is a view on arrow "A" of FIG. 9*b;*

FIG. 10 is a side cross-sectional view of a series of stacked, nested centrifugal impellers which comprise part of the pump apparatus of the present invention, similar to the view shown in FIG. 9*b*, but showing a different embodiment for the series of nested stacked impellers and the manner of nesting them;

DETAILED DESCRIPTION OF PREFERRED EMBODIMENTS

Figure 1:
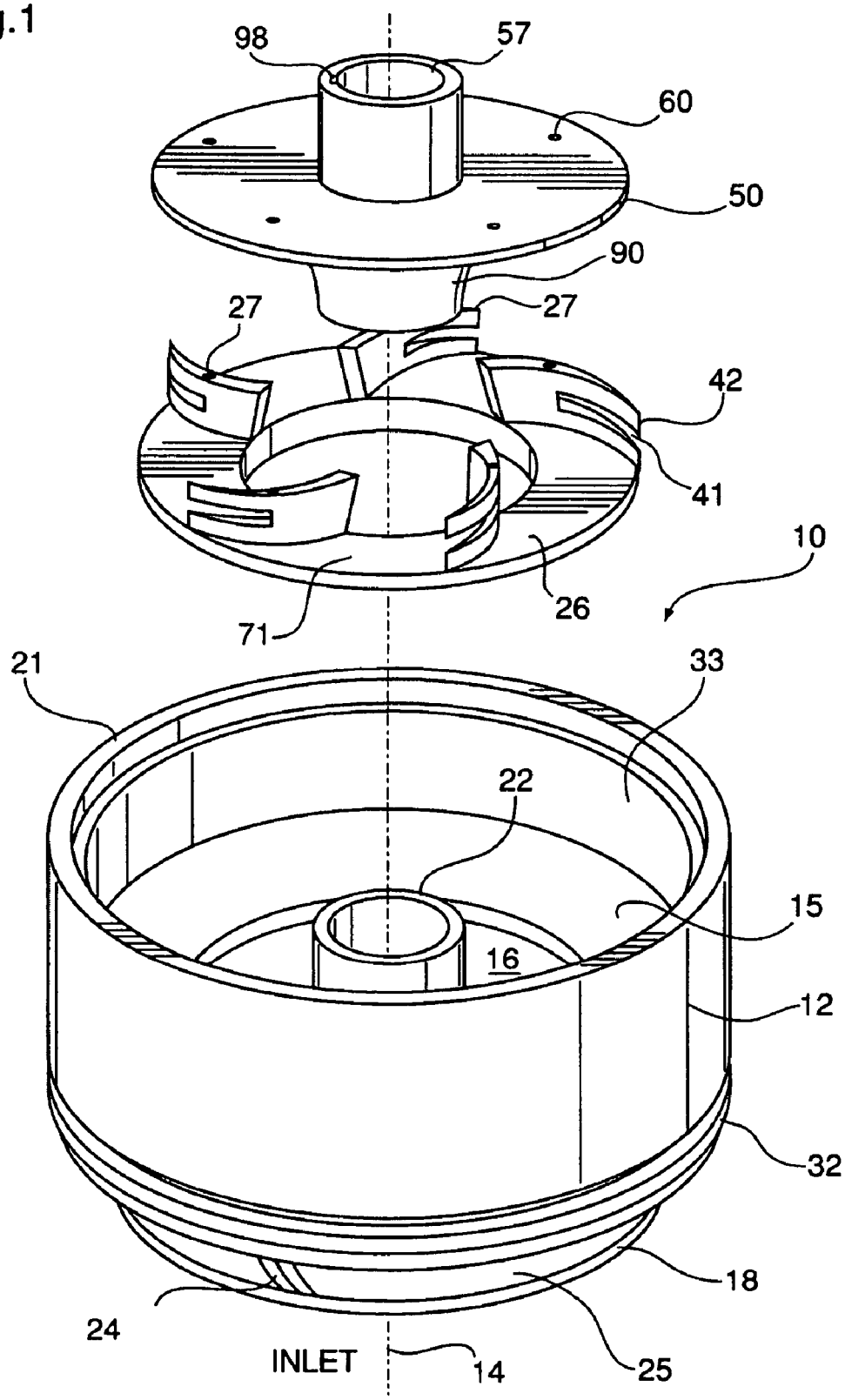
FIG. 1 is a perspective, exploded view of a single centrifugal pump stage of the present invention.

In all drawings figures, for consistency, identical components are identified with identical reference numerals.

FIG. 1 shows a perspective, exploded view of a single centrifugal pump stage 10 of the present invention.

Figure 2:
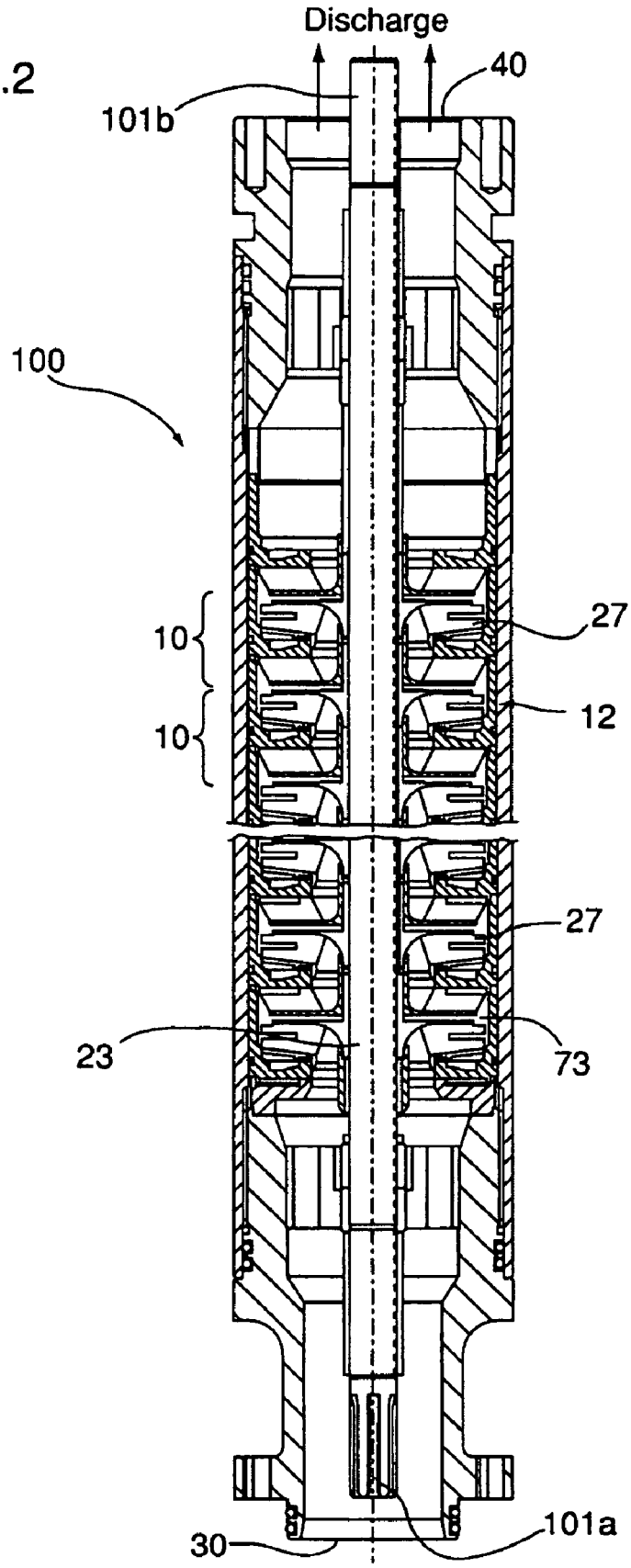
FIG. 2 is a cross-sectional depiction of a staged centrifugal pump apparatus of the present invention, comprising a series of stacked and nested impeller stages.

FIG. 2 shows an assembled cross-sectional view of the pump apparatus 100 of the present invention, comprising a plurality of pump stages 10 assembled end to end in series.

Generally speaking, for a pump apparatus 100 of the present invention, with each additional pump stage, the pressure head output is incrementally increased by the addition of successive numbers of pump stages 10. For example, if at a certain pump rpm (eg 3500 rpm—see Example 1, below) each pump stage 10 has an incremental pressure head of 8.4 psi, by combining each in series a combined pump apparatus 100 pressure head of 126 psi (15×8.5) can be achieved.

With reference to the exploded view shown in FIG. 1, FIG. 1 shows an exploded view of a single pump stage 10 of the present invention comprising a hollow cylindrical body 12 disposed about a central longitudinal vertical axis 14. Cylindrical body 12 has a lower horizontal wall 15, having a circular aperture 16 therein which is co-axial with the longitudinal axis 14.

Figure 3:
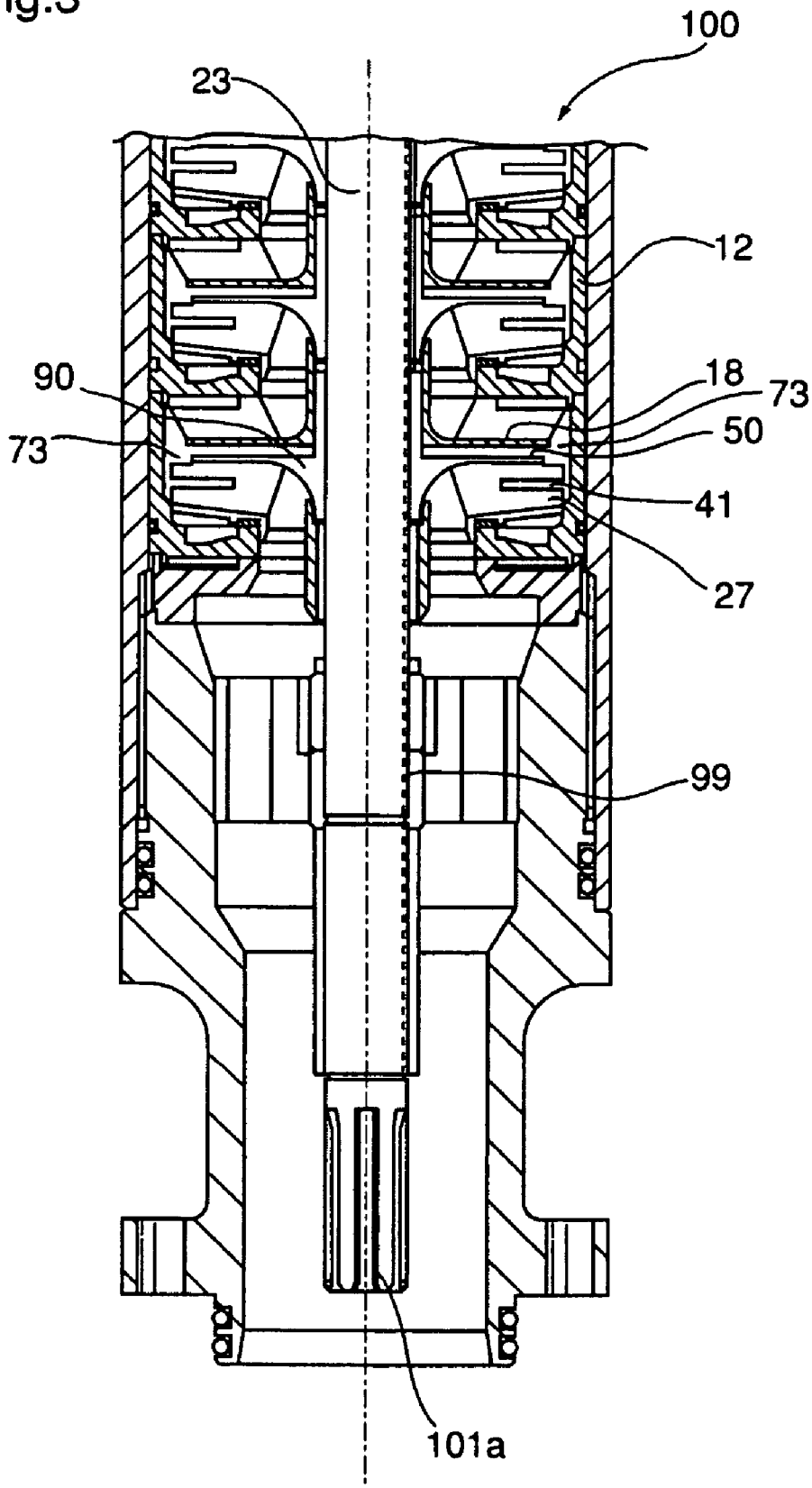
FIG. 3 is an enlarged view of the lower (ie suction) portion of the centrifugal staged pump apparatus shown in cross-section in FIG. 2.
Figure 11:
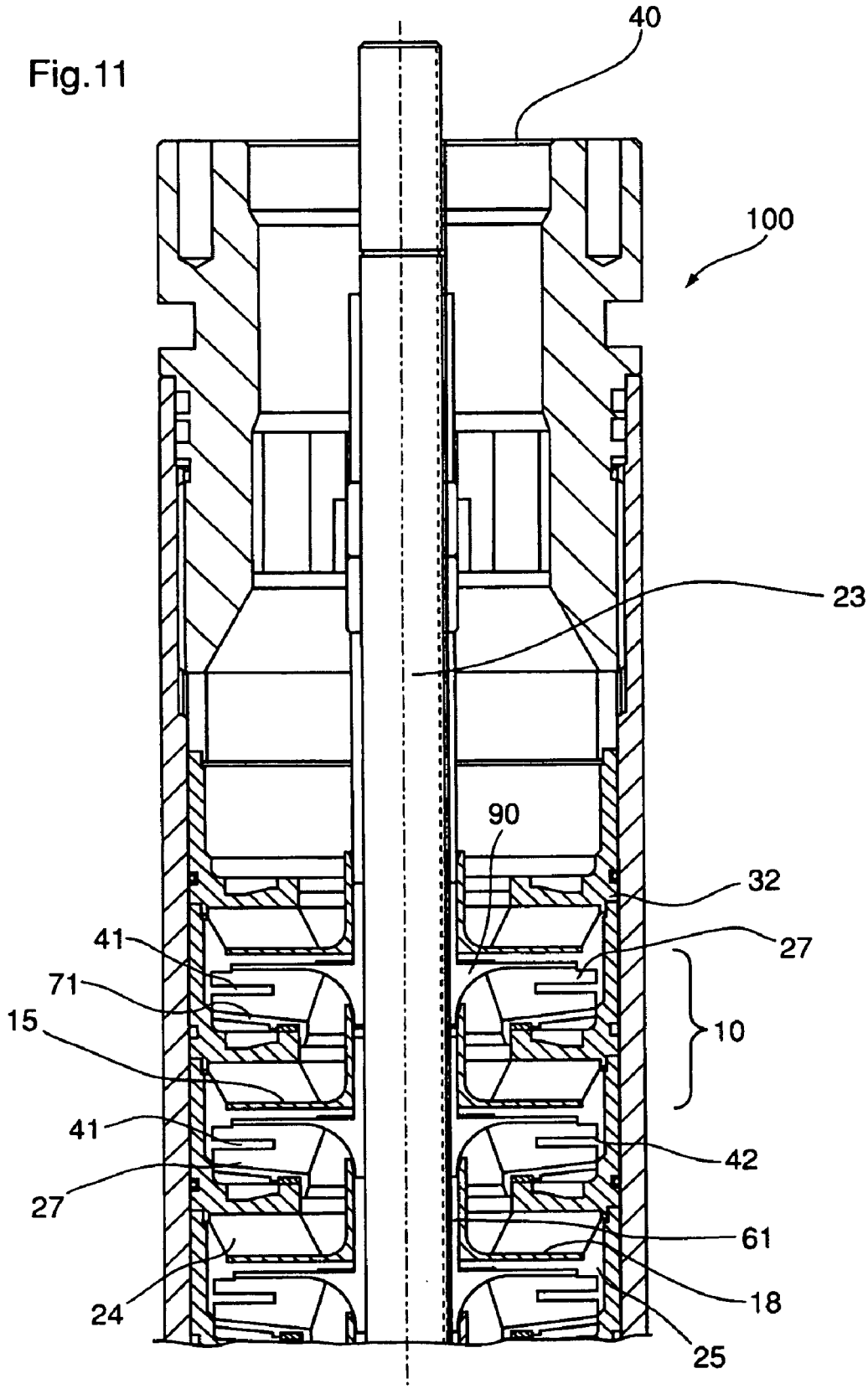
FIG. 11 is an enlarged view of the upper discharge end of the centrifugal pump apparatus of the present invention, as shown in FIG. 2.

A horizontal disc 18 is provided at a lowermost extremity of cylindrical body 12, perpendicularly disposed to longitudinal axis 14, of a lesser diameter than an outer uppermost periphery 21 of cylindrical body 12. Extending upwardly from horizontal disk 18 is a cylindrical tubular member 22, which is situated co-axial on longitudinal axis 14. Cylindrical tubular member 22 is adapted to receive a rotatable cylindrical shaft 23 therein (see FIGS. 2, 3 & 11)

Horizontal disc 18 is affixed to lower horizontal wall 15 by means of a series of struts 24 (best view shown in FIG. 5*b*), so as to be spaced apart from horizontal wall 15. Accordingly, and as seen from FIG. 1, by horizontal disc 18 being spaced apart from horizontal wall 15 an annular space 25 through which a viscous medium (not shown) can enter pump stage 10 is thereby created.

Figure 5A:
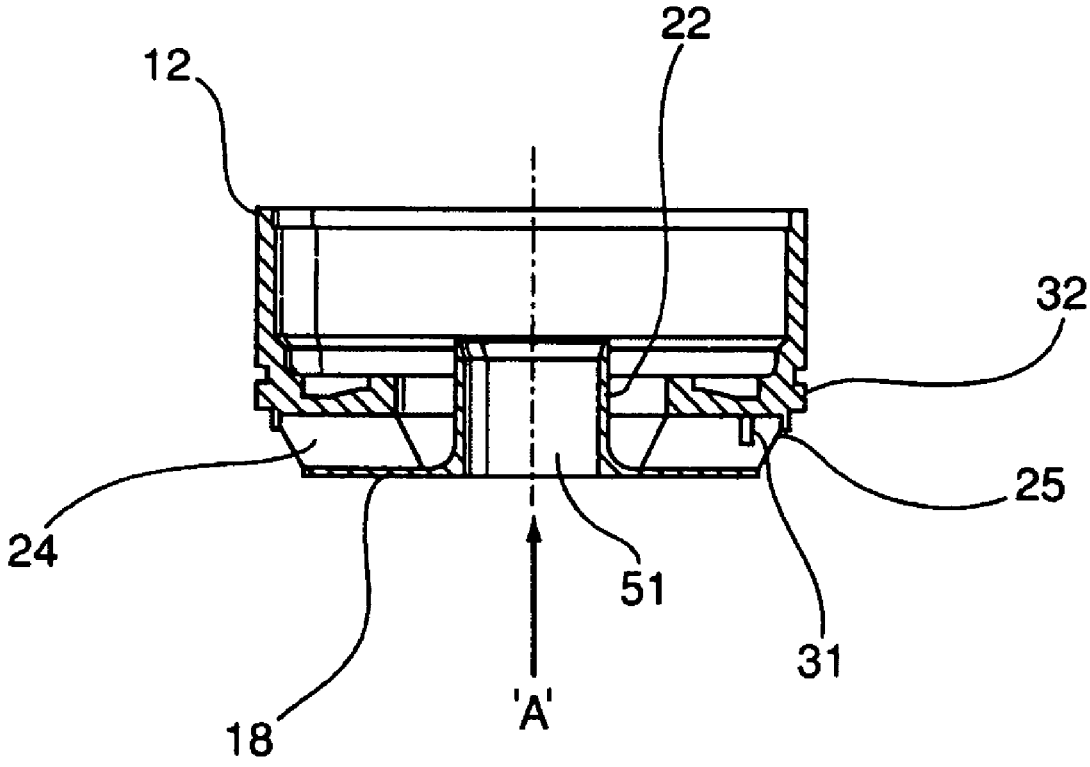
FIG. 5*a* is a side cross-sectional view of the entire cylindrical pump body of the present invention, showing the manner of attachment of the hollow circular disk to the lower horizontal wall of the cylindrical body shown in FIG. 4*a;*
Figure 5B:
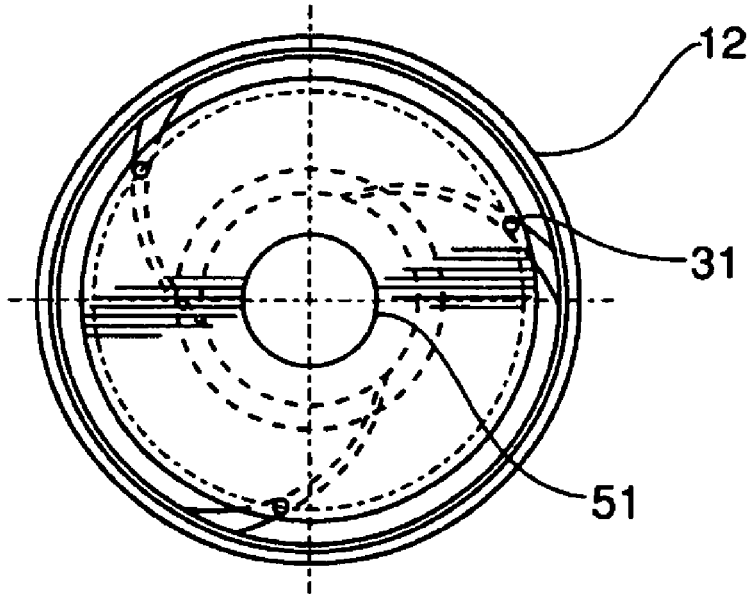
FIG. 5*b* is a view on arrow "A" of FIG. 5*a;*
Figure 6A:
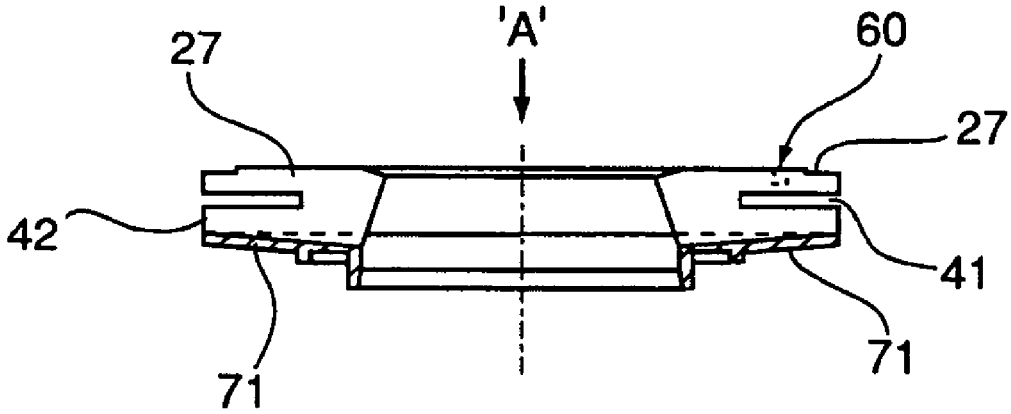
FIG. 6*a* is a side cross-sectional view on the impeller and rotatable vanes which form part of the pump apparatus of the present invention.
Figure 6B:
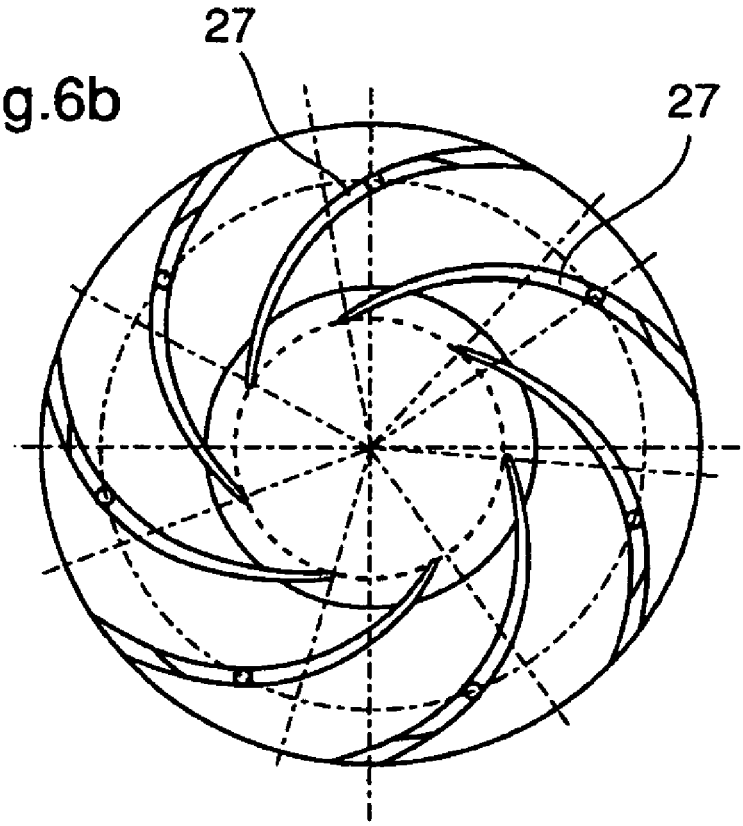
FIG. 6*b* is a view on arrow "A" of FIG. 6*a;*
Figure 7A:
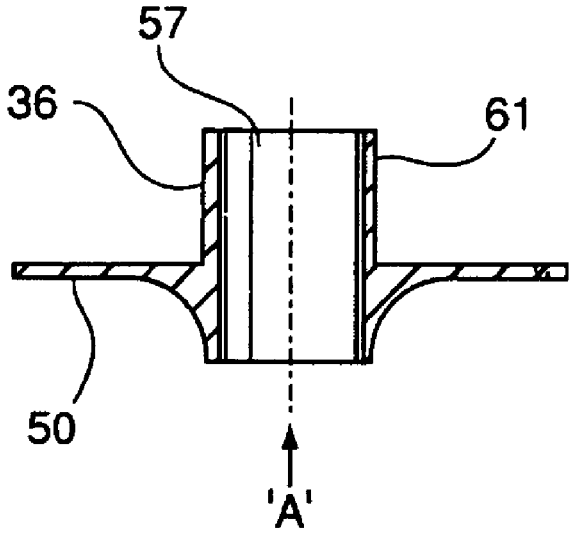
FIG. 7*a* is a side cross-sectional view of the rotatable disc member of the present invention.
Figure 7B:
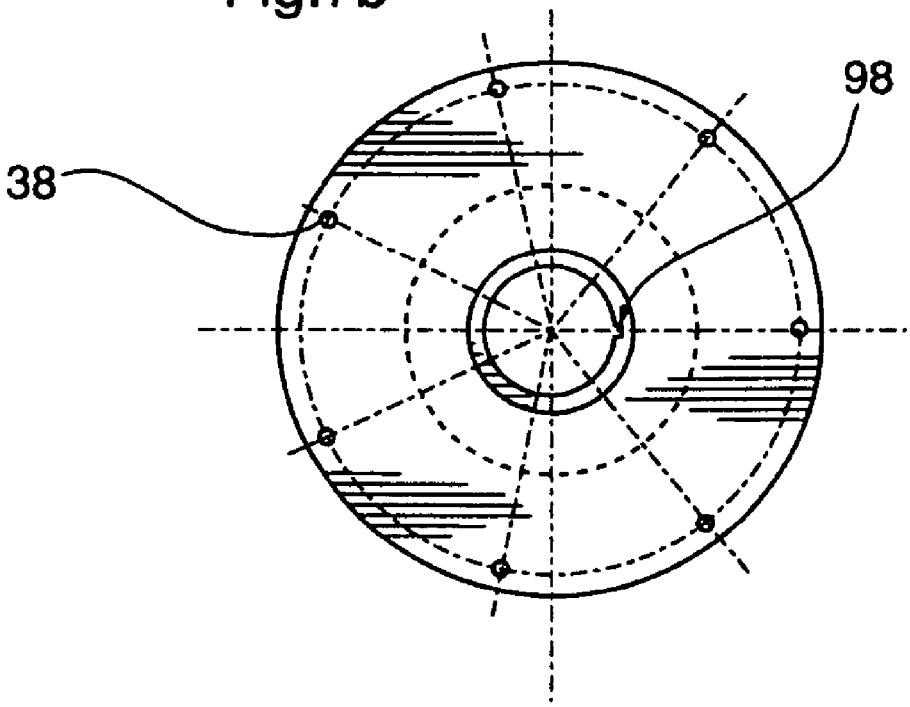
FIG. 7*b* is a view on arrow "A" of FIG. 7*a;*

As best shown in FIGS. 5*a* & 5*b*, horizontal disc 18 and integral cylindrical tubular member 22 may be affixed to cylindrical body 12 by way of a series of steel dowel pins 31, as shown in FIGS. 5*a* and 5*b*. Alternatively horizontal disc 18 may be affixed to cylindrical body 12 by any one of a number of means known to persons of skill in the art, such as by welding, threadable coupling, brazing, or being integrally formed with cylindrical body 12.

The viscous medium desired to be pumped enters annular area 25 as shown in FIG. 1 and is drawn upwardly through aperture 16 via the impeller assembly 26 as hereinafter explained. In the nested, end-to-end series of pump stages 10 shown in FIGS. 2 & 3 which together comprise the pump apparatus 100 of the present invention, the viscous fluid medium being pumped enters the pump apparatus 100 via suction end 30, and is discharged at discharge end 40.

Immediately above horizontal wall 16 the impeller assembly 26 is positioned. Impeller assembly 26 comprises a plurality of rotatable arcuate vane members 27, situated within hollow cylindrical body and above a lower extremity 32 thereof, namely above horizontal wall 15. Each of vane members 27 are symmetrically radially disposed about longitudinal axis 14 as best shown in FIG. 1 and are adapted for rotation about said longitudinal axis 14. Each of said vane members 27 extend radially outwardly from a position proximate said longitudinal axis 14 to a position proximate an inner periphery 33 of hollow cylindrical body 12, as again shown in FIG. 1 and also FIG. 2.

Importantly, each of vane members 27 possess a radially-outwardly extending horizontal slot 41, extending from proximate a mid-section of each of said vane members 27 radially outwardly to a position proximate a radial extremity 42 of each of said vane members 27.

Figure 8A:
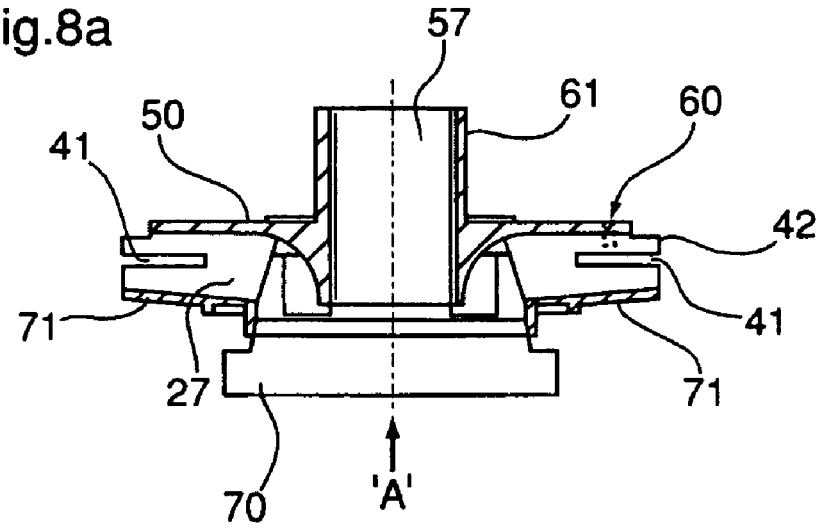
FIG. 8*a* is a side cross-sectional view of the impeller, rotatable disc, and flange member which are contained in the cylindrical body of the pump apparatus of the present invention.

Without being held to a definite explanation as to why the incorporation of horizontal slots or apertures 41 proximate the extremity 42 of an impeller vane 27 as best shown in FIG. 1 and FIG. 8*a* assists in reducing wear on impeller components when viscous fluids (containing abrasive wear-inducing suspended particles) are pumped, it is theorized that in viscous fluids, due to the large increase in speed that occurs as such fluid is pushed by the impeller vanes radially outwardly, that flow in the area of the vanes 27 in which the horizontal slots 41 are situated becomes extremely turbulent, thereby causing greater circulation and contact of abrasive components against pump components. By providing an aperture or horizontal slot 41 proximate the radially-most outward portion 42 of the vane 27, preferably in the area midsection of the vane 27 where the exit speeds of the fluid are normally highest, the speed of the pumped fluid in this localized area can be reduced, thereby allowing fluid which may be in a boundary layer proximate to pump equipment to be entrained as approximately the same speed. It is theorized that the resultant effect is that laminar flow is able to be maintained over a greater portion of the fluid flow within each pump stage 10, thereby increasing the speed of fluid through each pump stage 10 and the increasing the efficiency of the pump apparatus 100 for the horsepower expended.

Figure 8B:
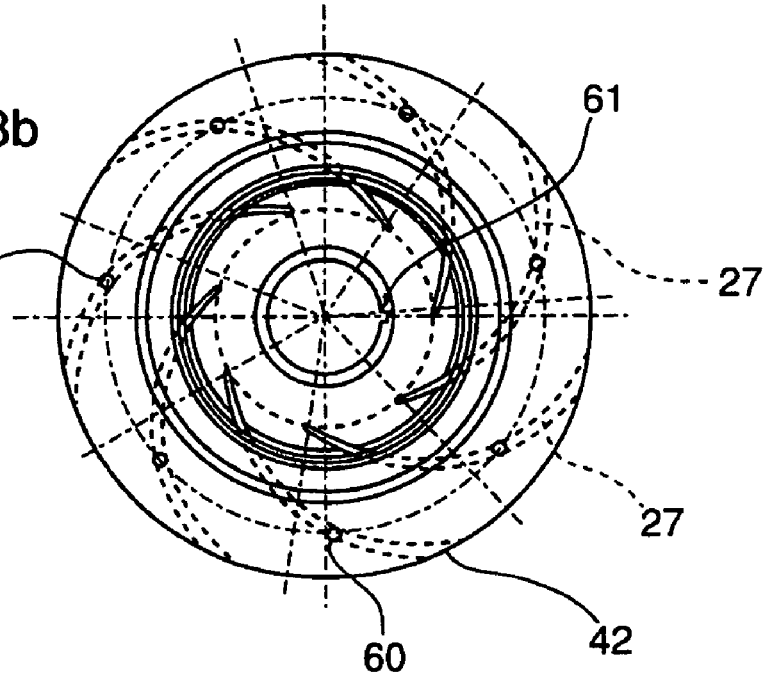
FIG. 8*b* is a view on arrow "A" of FIG. 8*a;*
Figure 8C:
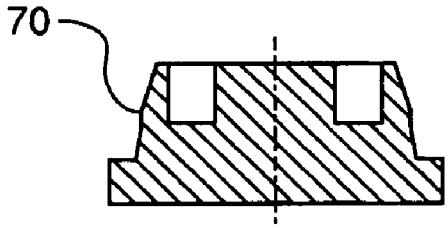
FIG. 8*c* is a cross-sectional view of the flange member shown in FIG. 8*a;*

Above vanes 27 a flat horizontally disposed disc member 50 is provided, disposed immediately above said vane members 27 and perpendicularly disposed to longitudinal axis 14. In a preferred embodiment, disc member 50 is fixedly coupled to each of vanes 27 by means of steel dowel pins 60 inserted in apertures 61 in disc member 50, as shown in FIGS. 8*a*, 8*b*, and disc member 50 is rotatable with the vanes 27. Of course, other means of affixing disc member 50 to vanes 27 may be used as are known to persons of skill in the art, such as by welding or brazing. Alternatively, the vanes and disc member 50 may be milled from a single billet of material.

A cylindrical annular member 61 integral with disc member 50 extends perpendicularly vertically upwardly from horizontal disc member 50. Annular member 61 and disc member 50 are adapted to be positioned co-axially along longitudinal axis 14. As seen in FIG. 1, the diameter of disc member 50 is less than the inner diameter of inner periphery 33 of pump body 12, while the outer diameter of annular ring member 71 on which vanes 27 in a preferred embodiment are situate is substantially equal to the inner diameter of inner periphery 33 of pump body 12, to allow formation of an annular aperture 73 where fluid being expelled radially outwardly from vanes 27 can be forced into the resulting annular aperture 73 and hence upwardly in pump stage 10 into the inlet area 26 of a further pump stage 12 which is stackably nested within the upper portion 21 of pump body 12, as shown in FIGS. 2, 3, 9*b*, 10 & 11.

Disc member 50, on the underside thereof and opposite annular member 61 thereof, has a downwardly extending curvilinear member 90, as shown in FIG. 1 and also in FIG. 9*b* and FIG. 10. Curvilinear member 91 possesses a smooth curved surface, to introduce uniformly viscous fluid which is drawn upwardly into rotating vanes 27, which thereafter expel such viscous fluid radially outwardly against inner periphery 33 of outer body 12 and into annular aperture member 61 and curvilinear member 90 co-operate to together form a vertical tubular aperture 57 through the entirety of disc member 50, through which rotatable shaft 23 may be inserted. Notably, tubular aperture 67 possesses a keyed shaft or female spline 98, which is adapted to matingly engage a similar male keyed spline 99 on shaft 23, so that shaft 23 may turn impeller assembly 26 and vanes 27. Rotatable shaft at each of its opposite ends 101*a*, 101*b*, possesses a series of splines, to allow mating engagement with a motor shaft to power pump apparatus 100.

Notably, FIG. 9*b* and FIG. 10 show two alternative configuration for cylindrical tubular member 22 on circular disc 18, which has circular aperture 51 therein for receiving rotatable shaft 23. In a first embodiment shown in FIG. 9*b*, cylindrical tubular member 22 has a greater inner diameter than the outer diameter of curvilinear member 90, and curvilinear member 90 is nestably inserted within tubular member 22, as shown in FIG. 9*b*.

In an alternative configuration for tubular member 22 shown in FIG. 10, tubular member is of a lesser height, and in such configuration a lower portion 91 of curvilinear member 90 abuts upper portion 62 of annular member 61.

Example 1

The pump apparatus 100 of the present invention was tested on the 100 hp test bench with silicone oil. Due to the horsepower limitation of the test bed, the pump apparatus was only used with fifteen pump stages 10, and thus only had a lift of 150-200 m of the viscous fluid (described below) in order to keep the hydraulic torque manageable.

The prototype pump apparatus 100 of the present invention was tested with fifteen stages, with a design of approximately 20' of lift per pump state 10.

Each pump apparatus comprised an impeller assembly 26 having eight vanes, arcuate as shown in the attached Figures, of approximate 90 mm in height, with an outer portion of each vane 42 forming a circular periphery of approximately 82 mm.

Importantly, horizontal slots 41 in the outer periphery of each vane 27 were of approximately 2 mm in height, and covered an arcuate length on each vane 27 of approximately 28 mm of an approximate 50 mm (mid vane) arcuate length.

The pump apparatus 100 was tested at various speeds to determine the impact on performance and efficiency. In addition to the standard 3500 RPM, tests at speeds of 500, 1000, 1750, and 3000 RPM were completed.

The viscous fluid medium used was silicon oil having a viscosity of 5,000 cP at the measured operating temperature of 20° C. In the silicone oil test setup, the motor (not shown) used to power rotatable shaft 23 of pump apparatus 100 was coupled via spline coupling 80 to pump apparatus 100. Pump apparatus 100 drew directly via suction end 30 thereof from a tank of silicone in an open loop system. There was only 1-2' of fluid level above the suction end 30 when immersed in silicone oil.

Data was collected for speed, reactive motor torque, flow rate, and discharge pressure.

(i) Test Results

The pump apparatus 100 was tested at 500, 1000, 1750, 3000, and 3500 RPM. The test results are shown in FIG. 12.

Pump head of pump apparatus 100 gradually declined as flow rate increased, with a maximum pump efficiency being reached at a flow rate of approximately 20 $m^3$/Day. The no-load flow rates varied from 40 $m^3$/D at 1000 RPM, to 100 $m^3$/D at 1750 RPM, to as high as 170 $m^3$/D at 3500 RPM. The maximum lift achieved was 89 m (127 psi, 292 feet) when running at 3500 RPM. With 15 stages in pump apparatus, this equates to 19 feet of lift per stage, which is very close to the stated design lift of 20' per stage.

Figure 12:
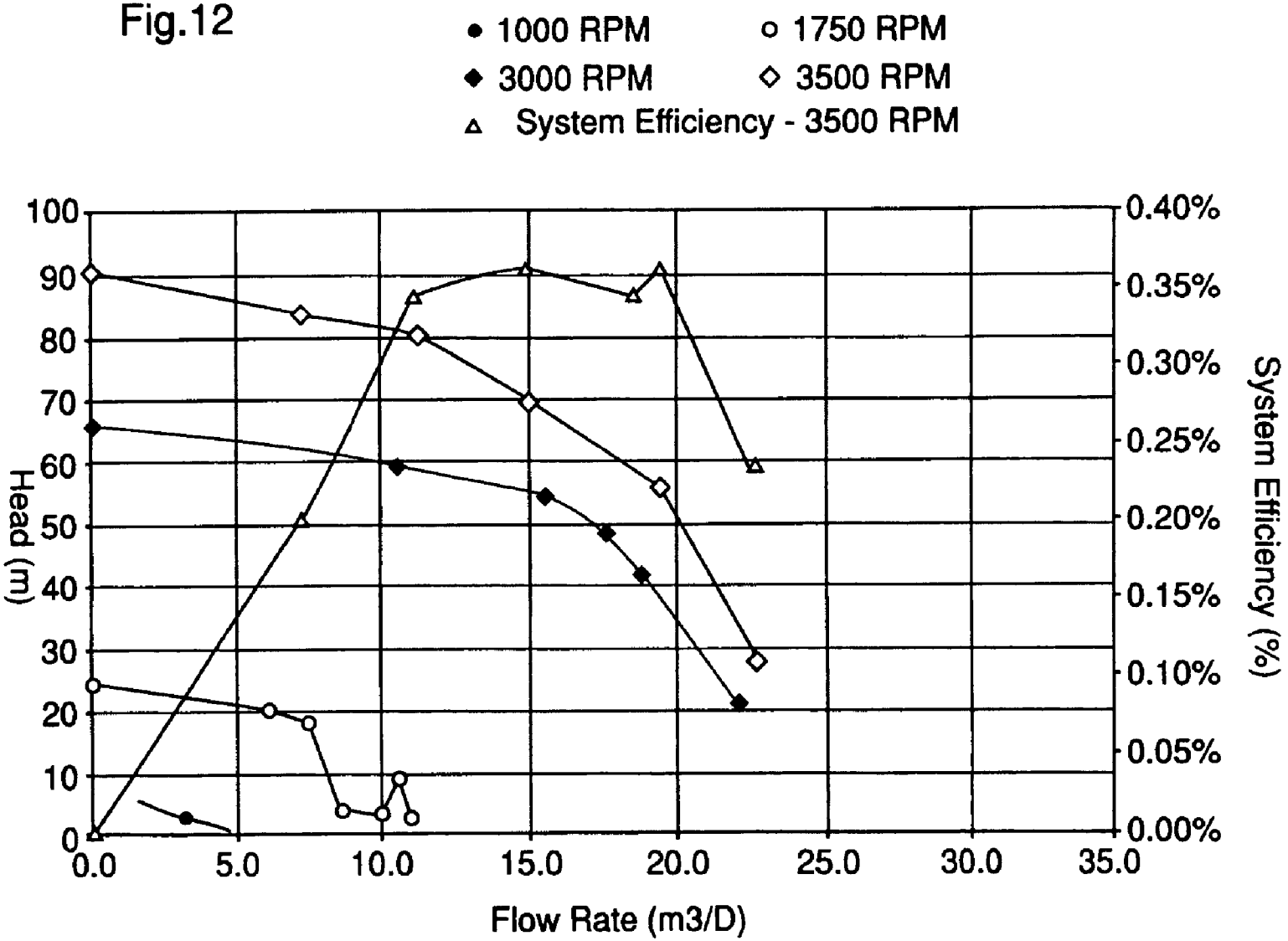
FIG. 12 is a graph of flow rate vs. head from an experimental test result using a 15-stage centrifugal pump apparatus of the present invention, using liquid silicone as the viscous medium.

The pump apparatus 100 efficiency curve for 3500 RPM is overlaid on the performance chart in FIG. 12.

Although the disclosure describes and illustrates preferred embodiments of the invention, it is to be understood that the invention is not limited to these particular embodiments. Many variations and modifications will now occur to those skilled in the art. For a complete definition of the invention and its intended scope, reference is to be made to the summary of the invention and the appended claims read together with and considered with the disclosure and drawings herein.

The invention claimed is:

1. A pump apparatus for pumping a viscous fluid upwardly, comprising:

(a) a hollow, cylindrical body disposed about a central longitudinal vertical axis, having aperture means proximate a lower extremity thereof to allow ingress of said viscous fluid about an exterior periphery thereof and to direct said viscous fluid upwardly along said longitudinal axis and within said cylindrical body; said hollow cylindrical body comprising therewithin:

(b) a plurality of rotatable arcuate vane members, situated within said hollow cylindrical body and above said lower extremity and symmetrically radially disposed about said longitudinal axis, adapted for rotation about said longitudinal axis, each of said vane members extending radially outwardly from a position proximate said longitudinal axis to a position proximate an inner periphery of said hollow cylindrical body;

(c) a flat, horizontally disposed disc member, disposed immediately above said vane members, perpendicularly disposed to said longitudinal axis;

(d) a viscous fluid egress area proximate a radial extremity of said vane members and said disc member and situated about said periphery of said hollow cylindrical body; and (e) each of said vane members possessing a radially-extending horizontal slot, extending from proximate a mid-section of each of said vane members radially outwardly to a position proximate a radial extremity of each of said vane members.

2. The pump apparatus of claim 1, wherein each of said vane members are coupled to and rotatable with said disc member, and said disc member is rotatable about said longitudinal axis.

3. The pump apparatus of claim 1 wherein said vane members are interposed between said disc member and a flat, horizontally disposed plate member.

4. The pump apparatus of claim 1, wherein said disc member is of a diameter less than an inner diameter of said hollow cylindrical body.

5. The pump apparatus of claim 1, said disc member having a cylindrical annular member extending perpendicularly vertically upwardly from said horizontal disc member, said cylindrical annular member adapted for coaxial alignment within said cylindrical body and along said central longitudinal axis thereof, wherein said cylindrical annular member possesses, on an inner periphery thereof, a vertical key means to permit fixed coupling to a rotatable shaft.

6. The pump apparatus of claim 1 wherein said cylindrical body has about its most upward periphery an engagement means to permit coupled engagement with a lower portion of a similar pump apparatus, to allow each to be coupled together in series.

7. A pump apparatus, adapted to be coupled in series with at least one other pump apparatus along a vertical longitudinal axis thereof to provide a staged pump apparatus, for pumping a viscous fluid upwardly, comprising:

(a) a hollow, cylindrical body disposed about said longitudinal vertical axis, having aperture means proximate a lower extremity thereof to allow ingress of said viscous fluid about an exterior periphery thereof and to direct said viscous fluid inwardly and upwardly along said longitudinal axis and within said cylindrical body;

(b) a plurality of arcuate vane members, situated within said cylindrical body and above said lower extremity, adapted for rotation about said longitudinal axis, each of said vane members and extending radially outwardly from a position proximate said longitudinal axis to a position proximate an inner periphery of said hollow cylindrical body;

(c) a flat, horizontally disposed rotatable disc member, rotatable within said hollow cylindrical body about said longitudinal axis, perpendicularly disposed to said longitudinal axis;

(d) a viscous fluid egress area disposed above said vane members and situated about said periphery of said hollow cylindrical body; and (e) each of said vane members possessing a radially-extending horizontal slot, extending from proximate a mid-section of each of said vane members radially outwardly to a radial extremity of each of said vane members.

8. The pump apparatus of claim 7, wherein each of said vane members are coupled to said disc member.

9. The pump apparatus of claim 7, wherein said disc member is positioned immediately above each of said vane members, and said vane members are interposed between said disc member and a flat horizontally-disposed plate member.

10. The pump apparatus of claim 7, wherein said disc member is of a diameter less than an inner diameter of said hollow cylindrical body.

11. The pump apparatus of claim 7, said disc member having an cylindrical annular member extending perpendicularly vertically upwardly from said horizontal disc member, said cylindrical annular member adapted for coaxial alignment within said cylindrical body and along said central longitudinal axis thereof, wherein said cylindrical annular member possesses, on an inner periphery thereof, a vertical key means to permit fixed coupling to a rotatable shaft.

12. The pump apparatus of claim 7 wherein said cylindrical body has about its most upward periphery an engagement means to permit coupled engagement with a lower portion of a similar pump apparatus, to allow each to be coupled together in series.

13. A centrifugal pump apparatus, adapted to be coupled in series with other similar centrifugal pump apparatus along a vertical longitudinal axis thereof to provide a staged pump apparatus, for pumping a viscous fluid upwardly, comprising;

(a) a hollow, cylindrical body disposed about said longitudinal vertical axis, having a lower horizontal wall perpendicularly disposed to said horizontal axis with a circular aperture therein co-axial with said longitudinal axis;

(b) a horizontal circular disc at a lowermost extremity of said hollow cylindrical body, perpendicularly disposed to said longitudinal axis and of lesser diameter than said cylindrical body, having an upwardly-extending cylindrical tubular member situated co-axial with said vertical longitudinal axis, adapted to receive a rotatable cylindrical shaft therein, said disc affixed to said lower horizontal wall and beneath said lower wall but spaced apart therefrom thereby forming aperture means beneath a lower extremity of said cylindrical body adapted to allow ingress of said viscous fluid about an exterior periphery of said cylindrical body and to direct said viscous fluid inwardly and upwardly along an exterior of said cylindrical member and within said cylindrical body;

(c) a plurality of rotatable vertically-extending vane members, situated within said cylindrical body and above said lower horizontal wall, disposed about said longitudinal axis adapted for rotation about said longitudinal axis, each of said vane members extending radially outwardly from a position proximate said longitudinal axis to a position proximate an inner periphery of said cylindrical body and each adapted to propel said viscous fluid directed upwardly within said cylindrical body via said cylindrical member radially outwardly;

(d) a flat, horizontally disposed rotatable disc member, of lesser diameter than said cylindrical body, rotatable within said hollow cylindrical body about said longitudinal axis; and (e) each of said vane members possessing a radially-extending horizontal slot, extending from proximate a mid-section of each of said vane members radially outwardly to a radial extremity of each of said vane members.

14. The centrifugal pump apparatus of claim 13, wherein each of said vane members are coupled to and rotatable with said disc member, and said disc member is rotatable about said longitudinal axis.

15. The centrifugal pump apparatus of claim 13 wherein said vane members are interposed between said disc member and a flat, horizontally disposed plate member.

16. The centrifugal pump apparatus of claim 13, said disc member having an cylindrical annular member extending perpendicularly vertically upwardly from said horizontal disc member, said cylindrical annular member adapted for coaxial alignment within said cylindrical body and along said central longitudinal axis thereof, wherein said cylindrical annular member possesses, on an inner periphery thereof, a vertical key means to permit fixed coupling to a rotatable shaft.

17. The centrifugal pump apparatus of claim 13, said disc member disposed about a cylindrical annulus, wherein said cylindrical annulus possesses, on an inner periphery thereof, a vertical slot to receive a spline member to permit fixed engagement to a rotatable shaft.

18. The centrifugal pump apparatus of claim 13, wherein said cylindrical body has about an uppermost periphery thereof engagement means to permit coupled engagement with a lower portion of a similar pump apparatus to allow each to be coupled in series.

* * * * *